US005661853A

United States Patent [19]

Wilmot

[11] Patent Number: 5,661,853

[45] Date of Patent: Sep. 2, 1997

[54] UNITARY FINGERTIP PROTECTOR

[76] Inventor: Elizabeth C. Wilmot, 4 Ambergate Rise, Pittsford, N.Y. 14534

[21] Appl. No.: 574,272

[22] Filed: Dec. 18, 1995

[51] Int. Cl.[6] ..... A41D 13/00; D05B 91/04

[52] U.S. Cl. ..... 2/163; 2/21

[58] Field of Search ..... 2/21, 163, 161.6; 223/101

[56] References Cited

U.S. PATENT DOCUMENTS

| | | | |
|---|---|---|---|
| 837,896 | 12/1906 | Bourne | 2/21 X |
| 1,055,838 | 3/1913 | Torrance | 2/21 X |
| 2,069,449 | 2/1937 | Jensen . | |
| 2,232,396 | 2/1941 | Lee et al. . | |
| 2,409,101 | 10/1946 | Brittingham | 2/21 |
| 2,538,889 | 1/1951 | Swarin . | |
| 4,239,134 | 12/1980 | Joy | 223/101 |
| 4,751,747 | 6/1988 | Banks et al. . | |

FOREIGN PATENT DOCUMENTS

| | | | |
|---|---|---|---|
| 220452 | 5/1987 | European Pat. Off. | 2/163 |

*Primary Examiner*—Paul C. Lewis
*Attorney, Agent, or Firm*—Cumpston & Shaw

[57] ABSTRACT

Hand wear such as a glove having a plurality of relatively hard sockets affixed to the outside of the glove at the outer end of each digit receiving receptacle. The sockets are sized to receive the distal phalange of a gloved digit and provide an increased resistance to deformation, thereby protecting the finger tips during tasks which are finger tip intensive.

9 Claims, 3 Drawing Sheets

UNITARY FINGERTIP PROTECTOR

FIELD OF INVENTION

The present invention generally relates to fingertip protection, and more specifically to a unitary hand covering device that encapsulates the distal phalange of the fingers and the thumb.

BACKGROUND OF THE INVENTION

Finger and fingertip protectors have been in use for decades and have been constructed from various materials, some of which afford a degree of protection from external sources. However, most protective devices, such as described in U.S. Pat. No. 2,069,449, are bulky, cumbersome, and limit the range of hand motion. Other fingertip protection devices, such as described in U.S. Pat. No. 2,232,396 are comprised of several individual pieces which are easily lost, thereby rendering the unit as a whole useless. Further, the device described in U.S. Pat. No. 2,232,396 is to be used alone and not in concert with a glove. Other devices, such as the protector device described in U.S. Pat. No. 4,751,747, may provide various protection for the thumb and fingers, but are not sturdy enough to protect a fingernail from breaking or debris contamination. A need still exists for a sturdy, flexible, unitary fingertip protector device.

SUMMARY OF INVENTION

The present invention includes a glove with integral fingertip protectors, wherein the fingertip protectors are a plurality of hollow sockets defining cavities for receiving a distal gloved phalange, each socket having a sealed first end and an open second end; the sockets having a dorsal wall formed to overlie the outer surface of the finger nail and an adjacent portion of the finger, and a transversely and longitudinally arched palmar wall formed to lie against the tip and remaining portions of the finger at the end thereof, the palmar wall extending outwardly and downwardly from one side of the dorsal wall; the palmar wall having a first thickened area covering the fingerprint region of the respective digit to substantially resist deformation into the adjacent portion of the respective digit receiving receptacle and a second area, thinner than the first area, covering the fingernail region and the remaining area of the respective digit.

DETAILED DESCRIPTION OF THE PREFERRED EMBODIMENT

Figure 1:
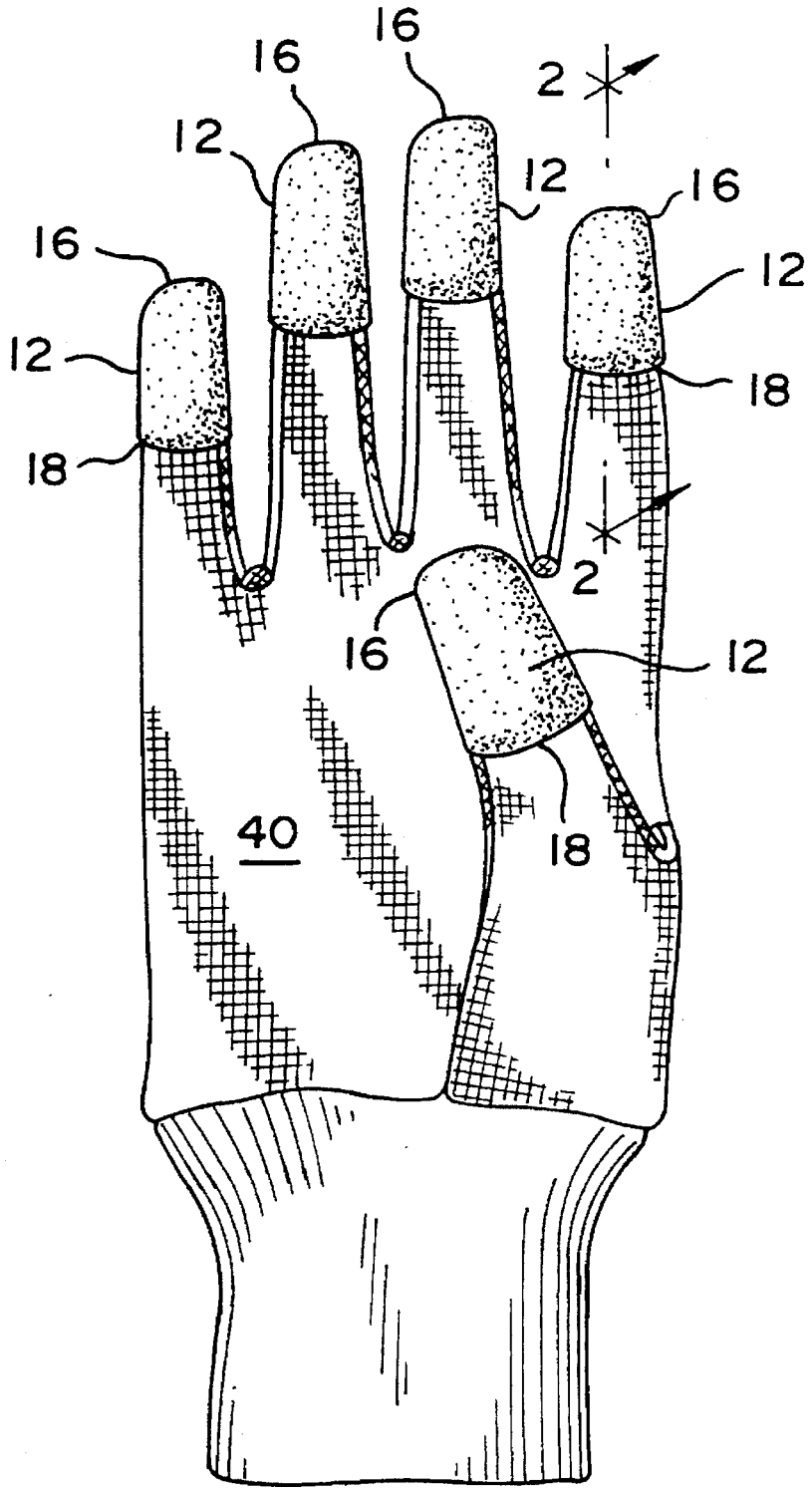
FIG. 1 is a palmar view of the fingertip protector in an operable position on a glove according to the invention.
Figure 2:
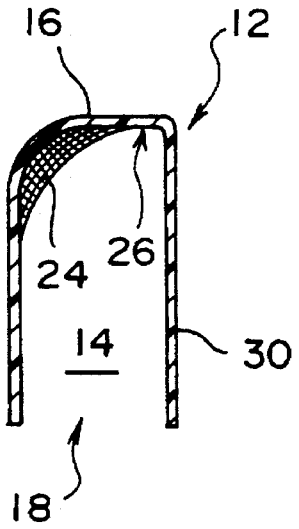
FIG. 2 is a cross sectional view of the socket taken along line 2–2 of FIG. 1.

The fingertip protector of the present invention is described in terms of a preferred embodiment, as shown in FIGS. 1 through 7. The preferred embodiment includes a plurality of hollow sockets 12 having cavities 14 for receiving a distal phalange of a gloved digit, as shown in FIGS. 1 and 2.

The glove may be any of a wide variety of types and styles of gloves including gardening, work or protective gloves.

The gloves may be made of cloth, canvas, leather, synthetic material or a combination of the materials. The glove may be open backed, gauntlet style or reinforced, depending upon the intended use. The gloves have a plurality of digit receiving receptacles for enclosing a corresponding digit.

Each socket 12 has a sealed first end 16, which contacts the gloved finger nail and tip of the finger, and an open second end 18, which allows the gloved finger to be inserted into the cavity 14 of the socket 12. The present invention protects both the fingertips and the thumb tips; however, for purposes of description, the invention is set forth in terms of digit tips which is understood to include both finger tips and thumb tips.

Figure 5:
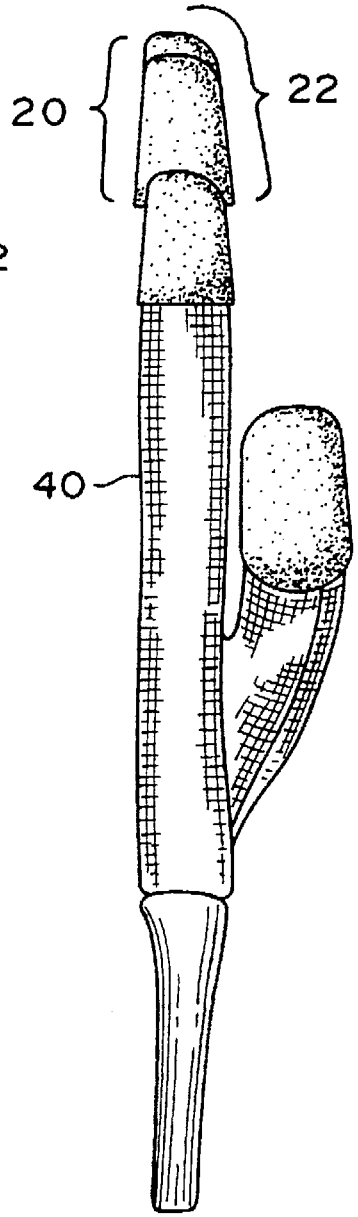
FIG. 5 is a side elevational view.

Referring to FIG. 5, each socket 12 has a dorsal wall 20 formed to overlie the outer surface of the gloved digit nail and adjacent potions of the digit. As the dorsal potion of the digit is substantially planar, the dorsal wall being formed to substantially conform to the digit is also substantially planar. Each socket further comprises a transversely and longitudinally arched palmar wall 22 extending outwardly and downwardly from each edge of the dorsal wall on one side of the dorsal wall 20 to cover the gloved digit including the palmar surface of the distal phalange of the digit.

Referring to FIG. 2, the sealed end 16 of each socket 12 includes a first thickened area 24 or shield in the palmar wall 22 covering the fingerprint region of the respective digit to substantially resist deformation into the adjacent portion of the respective digit receiving receptacle. The socket 12 includes a second area 30, thinner than the first thickened area 24, which covers the fingernail region and the remaining area of the respective digit. The second area 30 of the palmar wall 22 in the sealed end 16 includes an interior nail receiving recess 26 sized to receive a gloved digit nail.

The sockets 12 are constructed of a material having sufficient resiliency to flex to accommodate different sized gloved digit tips, within a predetermined range. It is intended that the sockets are made of a single material, preferably thermoplastic, natural or synthetic rubber, or any suitable material, and may be manufactured in different sizes. The socket material exhibits a greater rigidity and resistance to deformation than the digit receiving receptacles. The sockets may be formed by injection or rotational molding. The first thickened areas or shields 24 may be formed of the same material, but having an increased thickness and rigidity, or alternatively may be comprised of an alternative suitable material, such as hardened plastic or vulcanized rubber.

Figure 3:
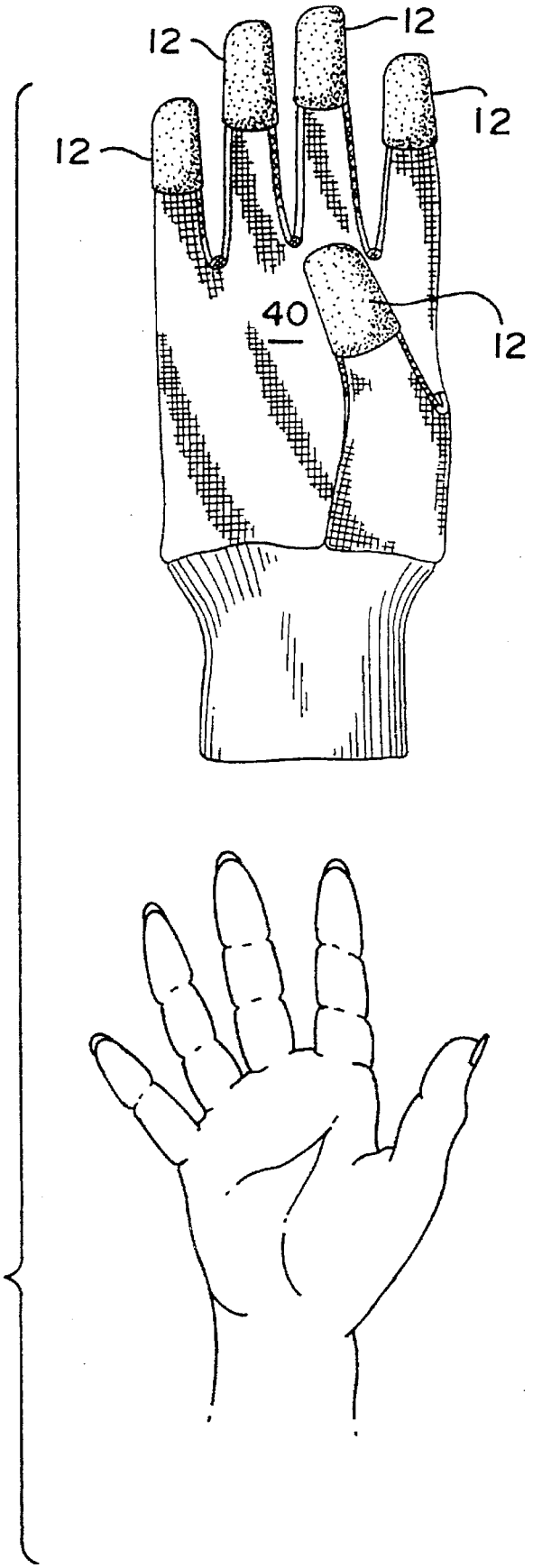
FIG. 3 is a palmar view of the fingertip protector on a glove showing the insertion of a hand.
Figure 4:
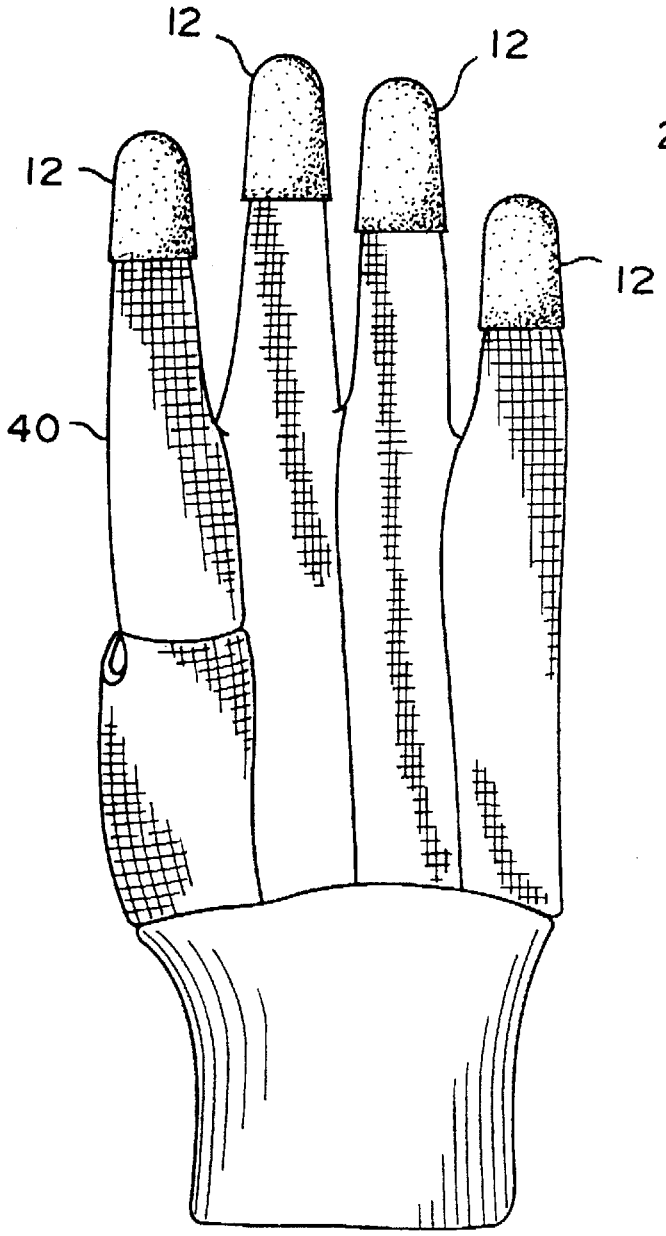
FIG. 4 is dorsal view of the present invention.

Referring to FIGS. 3 and 4, the sockets 12 are be individually attached to an exterior surface of a glove 40. The sockets 12 may be attached to the corresponding portion of the digit receiving receptacles of the glove by any of a variety of mechanisms, such as adhesives, hot adhesives, sewing, stitching, or rivet type engagement. Alternatively, the corresponding portion of the digit receiving receptacle may be formed or treated with a bonding material to supplement or even supplant the use of additional material. While it is contemplated that the socket and digit receiving receptacle may be attached by releasable mechanisms such as hook and loop fasteners, thereby allowing the customizing of the glove for differing applications, it is believed the forces encountered in the operating environment of the gloves requires a permanent attachment of the socket to the digit receiving receptacle. The glove thereby forms a boundary between the inside of the individual sockets and the hand. The glove increases comfort and reduces contact between any abrasive or rigid surfaces of the sockets and the skin.

By locating the finger tip protection of the sockets only at the outer phalange of the respective digit and substantially conforming the sockets to the digit tips, a user is able to retain substantial feel, control and accuracy of finger tips. Preferably, the sockets and the corresponding digit receiving receptacle are sized to substantially conform to the shape and size of the received digit. That is, sensitivity and control of protected digit tip is maximized when the space between the digit tip and the socket is minimized.

While the invention has been described in complete detail and shown in the accompanying drawings, it is not to be limited to such details, since many changes and modifications may be made without departing from the true spirit and scope of the invention. Hence, it is described to cover any and all modifications and forms which may come within the language and scope of the appended claims.

I claim:

1. Hand wear having integral fingertip protection, comprising:

(a) a glove having a plurality of digit receiving receptacles, each receptacle sized to receive a corresponding digit, the digit receiving receptacles formed of a bendable material having a first rigidity;

(b) a plurality of sockets having a second rigidity greater than the first rigidity, a respective socket attached to a corresponding digit receiving receptacle, the sockets including cavities for receiving a distal portion of the corresponding digit receiving receptacle, each socket having a sealed first end and an open second end, each socket having a dorsal wall formed to overlie the corresponding surface of the respective digit receiving receptacle, and a transversely and longitudinally arched palmar wall formed to lie against a tip of the respective digit receiving receptacle, the palmar wall extending outwardly and downwardly from one side of the dorsal wall, the palmar wall having a first thickened area spaced from an intersection of the dorsal wall and the palmar wall, the first thickened area covering the fingerprint region of the respective digit to substantially resist deformation into an adjacent portion of the respective digit receiving receptacle and the dorsal wall and a remaining portion of the palmar wall defining a second area, thinner than the first area, covering the fingernail region and a remaining area of the respective digit.

2. The hand wear of claim 1 wherein the sockets are sized to substantially enclose a distal phalange of a digit.

3. The hand wear of claim 1, further comprising an interior nail receiving recess in the second area in the palmar wall.

4. The hand wear of claim 1 wherein the sockets are integrally attached to the respective digit receiving receptacle.

5. The hand wear of claim 1 wherein the sockets are releasably attached to the respective digit receiving receptacle.

6. A method of forming protective hand wear having a plurality of digit receiving receptacles having a first rigidity, comprising:

(a) disposing a socket having a second rigidity greater than the first rigidity to a distal end of a digit receiving receptacle, each socket including a cavity for receiving the distal end of the respective digit receiving receptacle, each socket having a sealed first end and an open second end;

(b) locating in each socket a dorsal wall formed to overlie a corresponding surface of the respective digit receiving receptacle, and a transversely and longitudinally arched palmar wall formed to lie against a tip of the respective digit receiving receptacle, the palmar wall extending outwardly and downwardly from one side of the dorsal wall; and (c) disposing a shield in the sealed first end to be spaced from an intersection of the dorsal wall and the palmar wall to substantially resist deformation into an adjacent portion of the respective digit receiving receptacle.

7. The method of claim 6, further comprising:

(a) permanently attaching a socket to the respective digit receiving receptacle.

8. The method of claim 6, further comprising:

(a) releasably attaching a socket to the respective digit receiving receptacle.

9. The method of claim 6, further comprising:

(a) forming an interior nail receiving recess in the sealed first end.

* * * * *